US009079092B2

(12) United States Patent
Stack

(10) Patent No.: US 9,079,092 B2
(45) Date of Patent: Jul. 14, 2015

(54) TRAINING GLOVE

(76) Inventor: Joseph Stack, Saskatoon (CA)

( * ) Notice: Subject to any disclaimer, the term of this patent is extended or adjusted under 35 U.S.C. 154(b) by 553 days.

(21) Appl. No.: 13/082,289

(22) Filed: Apr. 7, 2011

(65) Prior Publication Data

US 2011/0247124 A1 Oct. 13, 2011

(30) Foreign Application Priority Data

Apr. 7, 2010 (CA) ..... 2698565

(51) Int. Cl.

| | |
|---|---|
| ***A63B 69/34*** | (2006.01) |
| ***A63B 71/00*** | (2006.01) |
| ***A63B 26/00*** | (2006.01) |
| ***A63B 23/14*** | (2006.01) |
| ***A63B 23/16*** | (2006.01) |
| ***A63B 71/14*** | (2006.01) |
| ***A63B 69/00*** | (2006.01) |
| *A63B 23/12* | (2006.01) |

(52) U.S. Cl.

CPC ..... *A63B 71/145* (2013.01); *A63B 69/004* (2013.01); *A63B 23/1236* (2013.01)

(58) Field of Classification Search

CPC .... A63B 21/00; A63B 21/0047; A63B 23/00; A63B 23/035; A63B 23/12; A63B 23/1209

USPC ..... 482/44–50, 83, 86–88, 92–96, 482/140–141, 131–132, 139; 2/16, 17, 2/158–160, 161.1, 161.6

See application file for complete search history.

(56) References Cited

U.S. PATENT DOCUMENTS

| | | | | |
|---|---|---|---|---|
| 2,837,745 | A * | 6/1958 | Nelson | 2/161.6 |
| 4,002,276 | A * | 1/1977 | Poncy et al. | 223/111 |
| 5,358,463 | A * | 10/1994 | Fuentes | 482/141 |
| 5,887,839 | A * | 3/1999 | Smith et al. | 248/452 |
| 6,740,051 | B2 * | 5/2004 | Hepburn et al. | 601/5 |
| 7,063,646 | B1 * | 6/2006 | Slimi | 482/45 |
| 7,377,888 | B2 * | 5/2008 | Godbold | 482/141 |
| 7,468,025 | B2 * | 12/2008 | Hauser et al. | 482/141 |
| 7,481,753 | B2 * | 1/2009 | James et al. | 482/140 |
| 7,503,884 | B1 * | 3/2009 | Schall | 482/141 |
| 7,585,262 | B1 | 9/2009 | Vayntraub | |
| 7,604,582 | B2 | 10/2009 | Abdallah | |
| 2006/0035771 | A1 | 2/2006 | Gant | |
| 2010/0216615 | A1 * | 8/2010 | Rios et al. | 482/142 |

FOREIGN PATENT DOCUMENTS

| | | |
|---|---|---|
| DE | 103 36 761 A1 | 1/2005 |
| WO | 2007/035773 A2 | 3/2007 |

* cited by examiner

*Primary Examiner* — Stephen Crow
*Assistant Examiner* — Garrett Atkinson
(74) *Attorney, Agent, or Firm* — Christensen O'Connor Johnson Kindness PLLC

(57) ABSTRACT

A training glove for training includes a training glove body and a rotatable turntable secured adjacent to a knuckle portion of the training glove body, such that when the training glove is in a pushup position on its knuckles, the training glove body rotates relative to the surface.

11 Claims, 3 Drawing Sheets

TRAINING GLOVE

FIELD

There is described a training glove which helps train boxers or mixed martial arts fighters to use forearm rotation.

BACKGROUND

Forearm rotation in combination with torso rotation gives a punch more power. U.S. Pat. No. 7,481,753 (James et al) entitled "Rotatable Push-Up Exercise Device" and U.S. Pat. No. 7,503,884 (Schall) entitled "Exercise Apparatus" both describe apparatus that requires forearm rotation when performing push up exercises. In order to use one of these apparatus, a person wearing training gloves must remove them. U.S. Pat. No. 5,358,463 (Fuentes) entitled "Exercise Device" goes a step farther and includes an embodiment that promotes forearm rotation when doing push ups with a clenched fist.

SUMMARY

There is provided a training glove, comprising a training glove body and a rotatable turntable secured adjacent to a knuckle portion of the training glove body, such that when the training glove is in a pushup position on its knuckles, the training glove body rotates relative to the surface.

According to another aspect, the rotatable turntable may have a first portion and a second portion, the first portion being secured to the training glove and the second portion being movable relative to the training glove. A friction-reducing insert may be positioned between the first portion and the second portion of the rotatable turntable. The friction-reducing insert may be bearings. The friction-reducing insert may be a wear plate.

According to another aspect, a mounting plate may secure the rotatable turntable to the training glove.

According to another aspect, a force distribution component may be positioned across the knuckle portion of the training glove body to distribute the pressure applied to the turntable along the knuckle portion of the training glove body.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
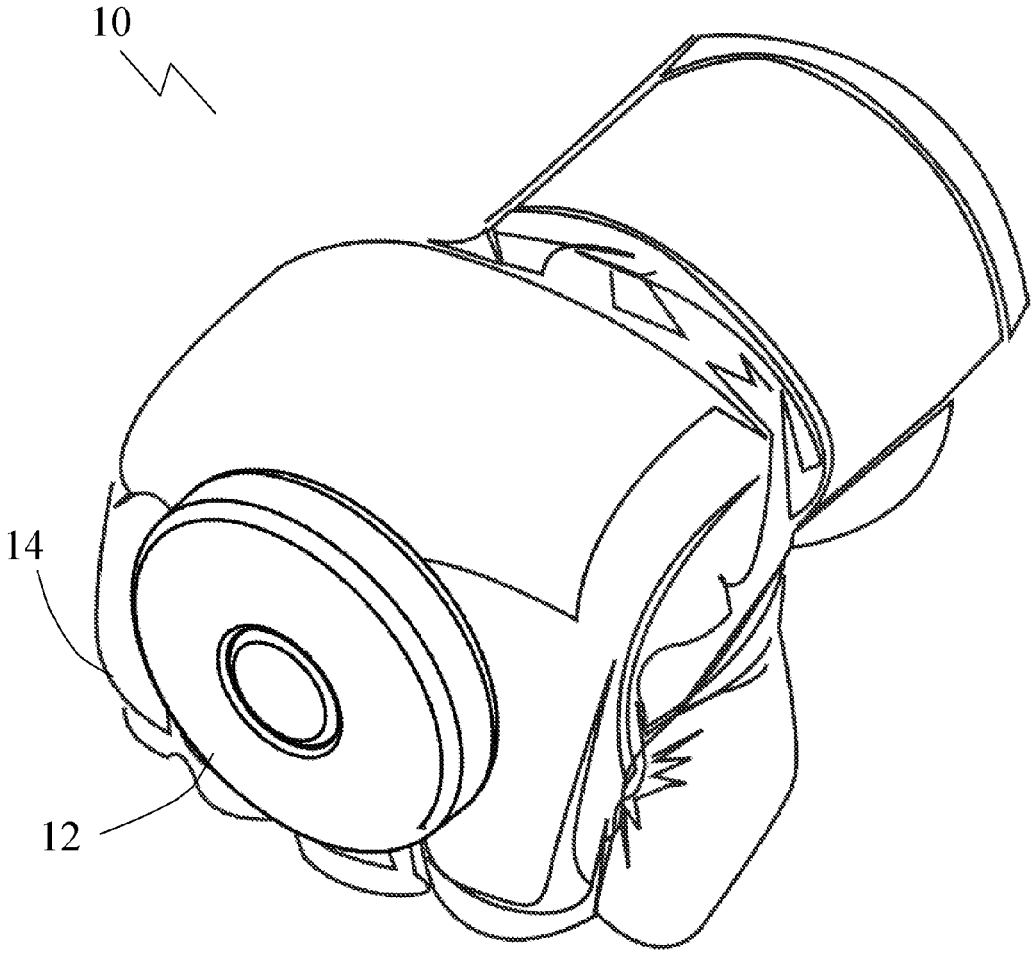
FIG. 1 is a perspective view of a training glove.

A training glove generally identified by reference numeral 10, will now be described with reference to FIGS. 1 through 4.

Figure 2:
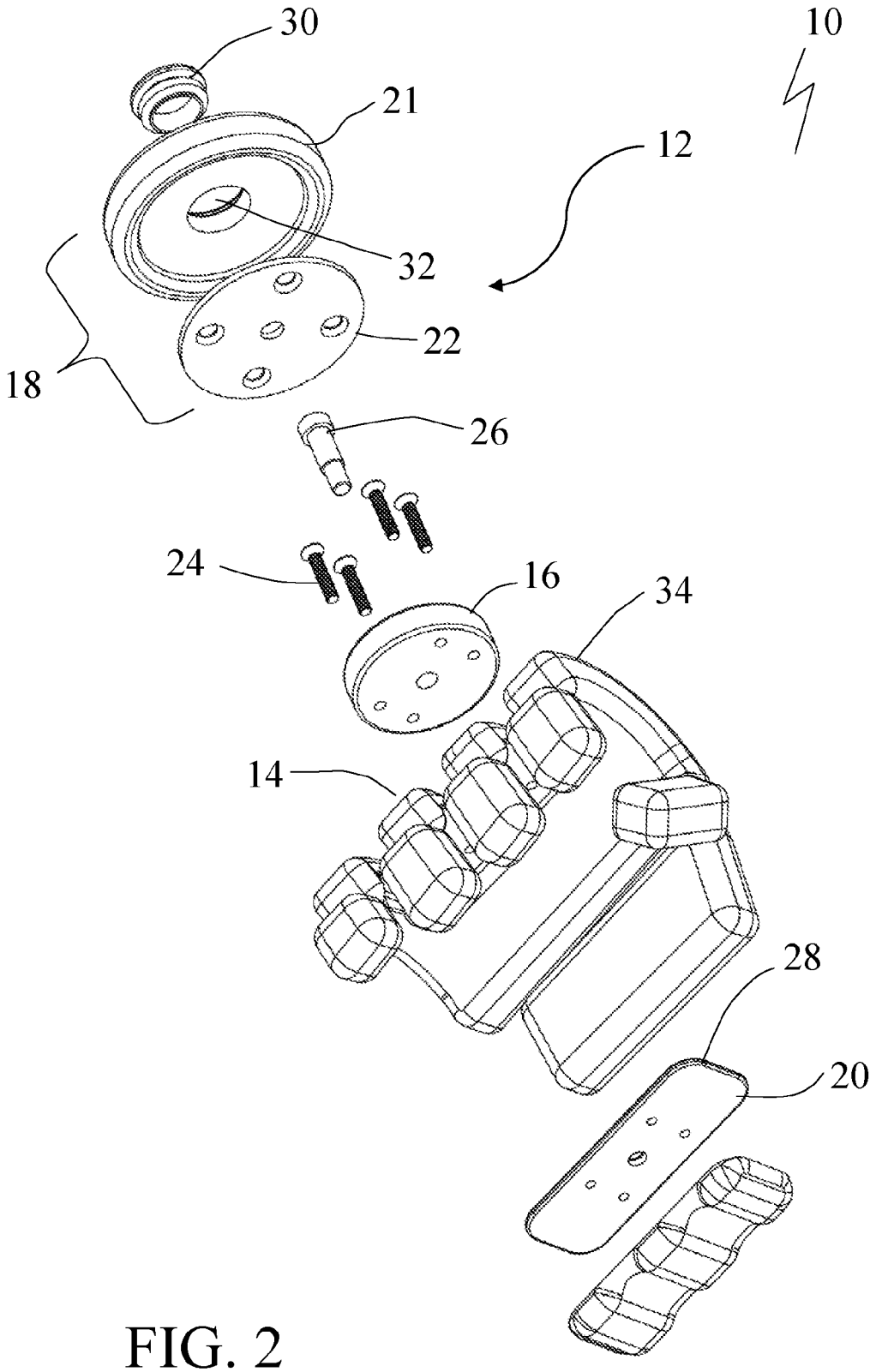
FIG. 2 is an exploded view of the outer section of the training glove shown in FIG. 1.
Figure 3:
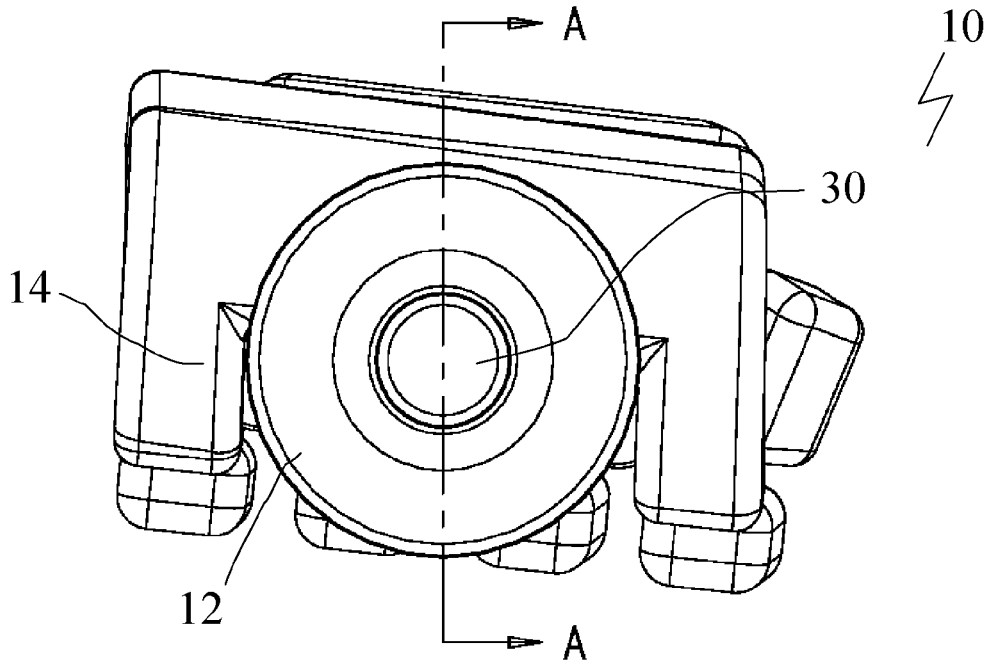
FIG. 3 is a front elevation view of the outer section of the training glove shown in FIG. 2.
Figure 4:
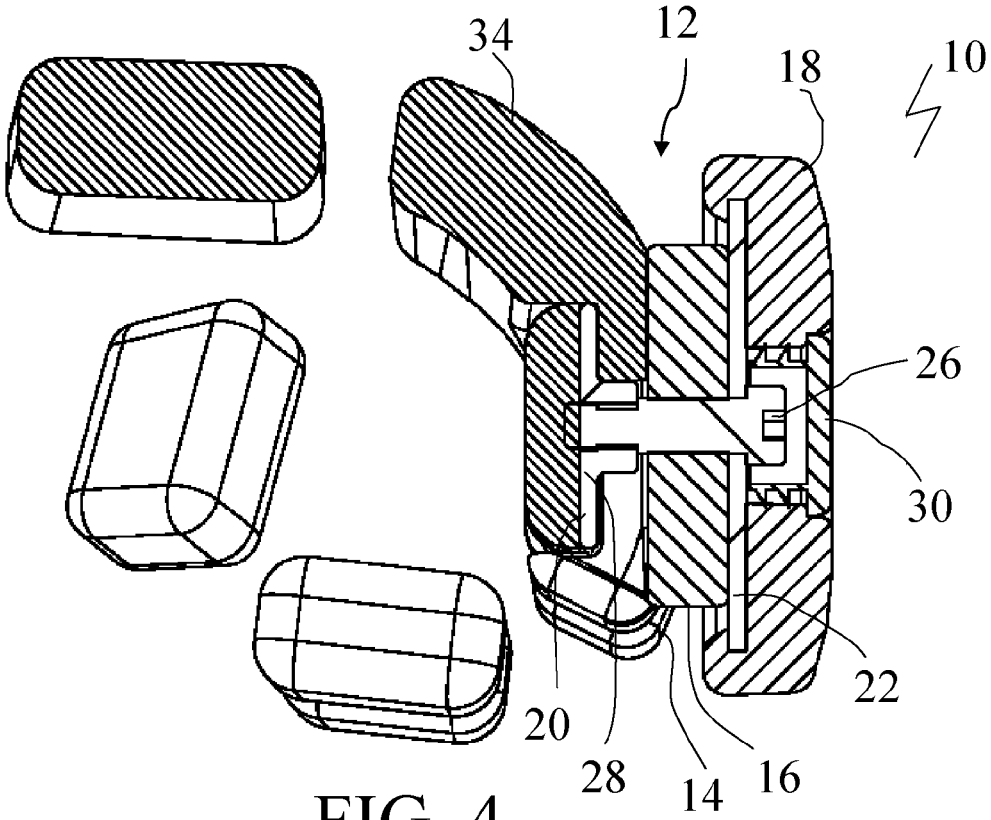
FIG. 4 is a side elevation view in section along the line A-A of the outer section of the training glove shown in FIG. 3.

Structure and Relationship of Parts:

Referring to FIG. 1, a training glove for training 10 has a rotatable turntable 12 secured to a knuckle portion 14 of training glove 10. Rotatable turntable 12 allows training glove 10 to rotate relative to a surface when training glove 10 is in a push-up position on its knuckles 14. Rotatable turntable 12 is positioned on the proximal phalanges portions of the knuckle portion 14, which are between the base knuckles and the second knuckles from the back of the user's hand. Referring to FIG. 2, a mounting plate 20 is carried by training glove 10 to secure rotatable turntable 12 in position. Rotatable turntable 12 is secured to mounting plate 20 using screws 24 as shown, but any other suitable method of attachment may equally be used. Referring to FIG. 2 and FIG. 4, rotatable turntable 12 has a first portion 16 and a second portion 18. First portion 16 is secured to training glove 10 and second portion 18 is movable relative to first portion 16. Second portion 18 is preferably made up of a molded, rubber portion 21 that is molded onto and engages a bearing surface 22, which may be made from, for example, stainless steel. Bearing surface 22 is shown with holes to allow for a stronger engagement between molded portion 21 and bearing surface 22. Molded portion 21 is preferably rubber, or another type of resilient material that helps provide a non-slip surface when engaging a ground surface, or at least a surface with a higher coefficient of friction than the coefficient between first portion 16 and second portion 18. First portion 16 may be a plastic that slides easily on stainless steel First portion 16 is preferably slightly concave to reduce the amount of surface contact with second portion 18. Based on these design considerations, modifications to the preferred design will be apparent to those skilled in the art.

First and second portions 16 and 18 are held together with a pin connector 26, which also acts as a pivot axis for turntable 12. Pin connector 26 threads into first portion 16, and has shoulders that ensure first and second portions 16 and 18 are held together, but with sufficient space to allow for movement between the components. A cap 30 may be provided to cover the hole 32 that extends through rotatable turntable 12 where pin connector 26 is inserted for securing to training glove 10. Bearing surface 22 may be used to promote fluid rotation and prevent binding of rotatable turntable 12 in combination with first portion 16. Bearing surfaces are preferably designed in order to minimize the number of mechanical parts as training glove 10 is used during training to hit objects such as punching bags, and the risk of damage and resulting decrease in performance increases with more mechanical components. However, other possible designs may include bearings, such as ball bearings (not shown).

It is preferable to distribute the pressure across all the knuckles of the user. However, while rotatable turntable 12 may be large enough to cover the entire knuckle portion 14 of training glove 10, it is preferable to make turntable 12 smaller to reduce interference with other training exercises. As shown, turntable 12 only covers the proximal phalanges portions of the knuckle portion 14 of training glove 10. In this design, in order to distribute the force applied to training glove 10 from the use of rotatable turntable 12, a force distribution component 28 may be positioned between turntable 12 and where the knuckles of the user will be positioned. As shown, component 28 is a plate that is positioned within the knuckle portion 14 of training glove 10. Force distribution component 28 distributes the pressure applied to each knuckle in order to approximate doing push-ups with the knuckles directly on a ground surface. This allows the training glove to work effectively even when rotatable turntable 12 does not fully cover the entire knuckle portion 14 of training glove 10. As shown, force distribution component 28 is the same as mounting plate 20, although they may also be separate components. It will be understood that turntable 12 may take different shapes, and force distribution component 28 may be part of first portion 16, rather than mounting plate 20, or may be mounted directly adjacent to either of these elements. Mounting plate 20 acts as force distribution components 28 based on its size. As shown, mounting plate 20 is positioned on the inside of an outer layer 34 of glove 10. As depicted, outer layer 34 contains the padding that is placed on the outside of training glove 10 that protects the user's hands. Screws 24 pass through outer layer 34 and attach to mounting plate 20, which secures first portion 16, and therefore turntable 12, to glove 10. An additional strip of padding 36 is preferably positioned on the inside of mounting plate 20 for the comfort of the user.

Operation:

Referring to FIG. 2, a person who is undergoing boxing training or mixed martial arts training places their hands into training glove 10. As a person performs a push up exercise or punches a punching bag, second portion 18 rotates relative to first portion 16 to permit rotation of the user's forearm. An insert 22, such as bearings or wear pads facilitates rotation of rotatable turntable 12. A force distribution component 28 is present within knuckle portion 14 of training glove 10 to distribute pressure evenly along the knuckle portion 14. While not suitable for sparring, training glove 10 allows a person to quickly move from punching bag exercises to push up exercises and other activities.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A training glove, comprising:

a training glove body comprising an inner side with palm and inner knuckle portions, and an outer side with back of hand and outer knuckle portions, the outer knuckle portion comprising a proximal phalange portion adjacent to the back of hand portion; and a rotatable turntable secured to the proximal phalange portion of the outer knuckle portion on the outer side of the training glove body such that when the training glove is in a knuckle pushup position where the proximal phalange portion is parallel to a ground surface and the outer knuckle portion bears a user's weight above the surface, the rotatable turntable is directly between the proximal phalange portion and the surface such that the training glove body rotates relative to the ground surface, the rotatable turntable comprising a rotating portion and a fixed portion secured to the training glove, the rotating portion being limited to rotation about a single pivot axis relative to the fixed portion, the rotating portion rotating in a plane parallel to the proximal phalange portion.

2. The training glove of claim 1, wherein a friction-reducing insert is positioned between the rotating portion and the fixed portion of the rotatable turntable.

3. The training glove of claim 2, wherein the friction-reducing insert is bearings.

4. The training glove of claim 2, wherein the friction-reducing insert is a wear plate.

5. The training glove of claim 1, wherein a mounting plate secures the rotatable turntable to the training glove body.

6. The training glove of claim 1, wherein a force distribution component is positioned across the outer knuckle portion of the training glove body to distribute the pressure applied to the turntable along the outer knuckle portion of the training glove body.

7. The training glove of claim 6, wherein the proximal phalange portion comprises four finger portions and the rotating portion of the rotatable turntable has a width that is greater than a combined width of at least two of the finger portions and less than a combined width of four of the finger portions.

8. The training glove of claim 1, wherein the training glove body comprises a boxing or mixed martial arts training glove body.

9. The training glove of claim 1, wherein the training glove body is flexible and permits movement between an open hand position and a closed first position.

10. The training glove of claim 1, wherein the rotating portion comprises a resilient material that resists movement relative to the ground surface when engaging the ground surface.

11. The training glove of claim 1, wherein the rotating portion comprises a non-slip engagement surface having at least a portion that is parallel to the proximal phalange portion such that when the training glove is in a knuckle pushup position the engagement surface resists movement of the training glove body relative to the ground surface.

* * * * *